US005224131A

United States Patent [19]

Searfoss

[11] Patent Number: 5,224,131

[45] Date of Patent: Jun. 29, 1993

[54] COUNTING APPARATUS

[75] Inventor: Timothy K. Searfoss, 2560 School Rd., Alger, Mich. 48610

[73] Assignees: Timothy K. Searfoss; Marlane C. Searfoss, Alger, Mich.

[21] Appl. No.: 897,927

[22] Filed: Jun. 15, 1992

[51] Int. Cl.[5] ..... B65D 25/16

[52] U.S. Cl. ..... 377/6; 377/15

[58] Field of Search ..... 377/6, 15

[56] References Cited

U.S. PATENT DOCUMENTS

| | | | |
|---|---|---|---|
| 4,472,819 | 9/1984 | Constantino | 377/6 |
| 4,545,062 | 10/1985 | Pray | 377/6 |
| 4,603,791 | 8/1992 | Spierer et al. | 377/6 |
| 5,090,031 | 2/1992 | Pyne et al. | 377/6 |

*Primary Examiner*—William L. Sikes
*Assistant Examiner*—Scott A. Ouellette
*Attorney, Agent, or Firm*—Brooks & Kushman

[57] ABSTRACT

Apparatus is provided for counting objects placed in a bin. The apparatus includes a shroud which covers the bin and which contains a hole through which the objects can be passed into the bin. A flexible paddle secured to the shroud extends into the hole so as to cover the hole when in a first position. The paddle can be flexed when an object is pressed against the paddle so as to move the paddle into a second position that permits passage of the object past the paddle into the bin. A counter is connected to the paddle to count paddle movement from the first position to the second position as each object is passed into the bin.

10 Claims, 2 Drawing Sheets

COUNTING APPARATUS

BACKGROUND OF THE INVENTION

Beverage container recycling is a major industry. Beverage container deposit laws, commonly called bottle deposit laws, are common in numerous states.

Under bottle deposit laws a bottling company usually sells the bottle and contents to a distributor. The distributor charges each retailer who receives the full bottles the amount of the usual bottle deposit. When the retailer sells the full bottle to a retail customer, the retailer charges the retail customer the amount of the bottle deposit paid to the distributor. When the customer returns the empty bottle to the retailer, the retailer pays the customer the amount of the bottle deposit. Employees of the retailer customarily are supposed to put 240 bottles or cans in an appropriate bag which is then sold back to the distributor by the retailer.

The volume of cans and bottles placed in a bag by a retailer for return to a distributor is variable depending on the amount of shaking given to the bag or box in which the empty containers are placed for return to the distributor.

It is common practice for distributors to supply the retailer with the boxes and bags in which the distibutor wants the used bottles to be returned, which is usually designed for a fixed amount such as 240 cans or bottles. A retailer who places more than 240 cans or bottles in the container to be returned to the distributor loses money by having paid the retail customer the full amount of the deposit for each can or bottle received and then only charging the distributor for 240 cans or bottles when more than 240 cans or bottles are placed in the box or bag for return to the distributor.

Some beverage distributors are known to have encouraged retailer mistakes by supplying the retailers with boxes and bags which are larger than needed for return of 240 cans or bottles and which may be marked with a line to indicate a full bag or box which is higher than the level of 240 cans or bottles in the bag or box. The distributor thus benefits both from receiving the benefit of retailer mistakes and receiving a scrap allowance for return of the bottles and cans.

Retailers having large stores utilize expensive can counting machines which each cost several thousand dollars, most of which also compress bottles and cans to fit into small bags or boxes for return to distributors.

Small retailers can't afford expensive counters and can't afford paying employees to laboriously count and log in a record book the quantity of cans and bottles received for return to the various distributors with whom the small store does business. Thus the small retailers each lose a considerable quantity of bottle deposit money to the distributors.

Since each store purchases beverages from several distributors, each store has to maintain a warehouse space for bottle returns in which numerous bags and boxes are situated for receiving each of the various types of beverage containers handled by the retailer.

It is therefore an object of this invention to provide apparatus for counting objects as they are placed in a bin.

It is a further object of this invention to provide counting apparatus which places a shroud over a top of a bin to separate counted objects from non-counted objects and which counts objects as they are passed through the shroud into the bin.

It is a further object of this invention to provide counting apparatus which utilizes a shroud to cover a bin, which counts objects as they are passed through the shroud into the bin, and which contains a recess in the shroud to hold one of the objects being counted to display the nature of the objects which are being passed through the shroud.

SUMMARY OF THE INVENTION

Apparatus is provided for counting objects placed in a bin. The apparatus includes a shroud which covers the bin and which contains a hole through which the objects can be passed into the bin. A flexible paddle secured to the shroud extends into the hole so as to cover the hole when in a first position and can be flexed to be moved out of the way when an object is pressed against the paddle so as to move the paddle into a second position that permits passage of the object into the bin. A counter is connected to the paddle to count paddle movement from the first position to the second position as each object is passed into the bin.

The paddle includes a free end which covers the hole and a fixed end which is attached to the shroud. Between the paddle ends a paddle extension is attached to the paddle and extends away from the hole and is connected through a tension spring to a counter arm so the counter remains out of the hole while being responsive to count each movement of the paddle from the first position to the second position as each object is passed through the hole into the bin. The shroud includes a recess for receiving one of the objects to identify the objects which are to be passed through the counting apparatus into the bin.

DESCRIPTION OF THE PREFERRED EMBODIMENT

Figure 1:
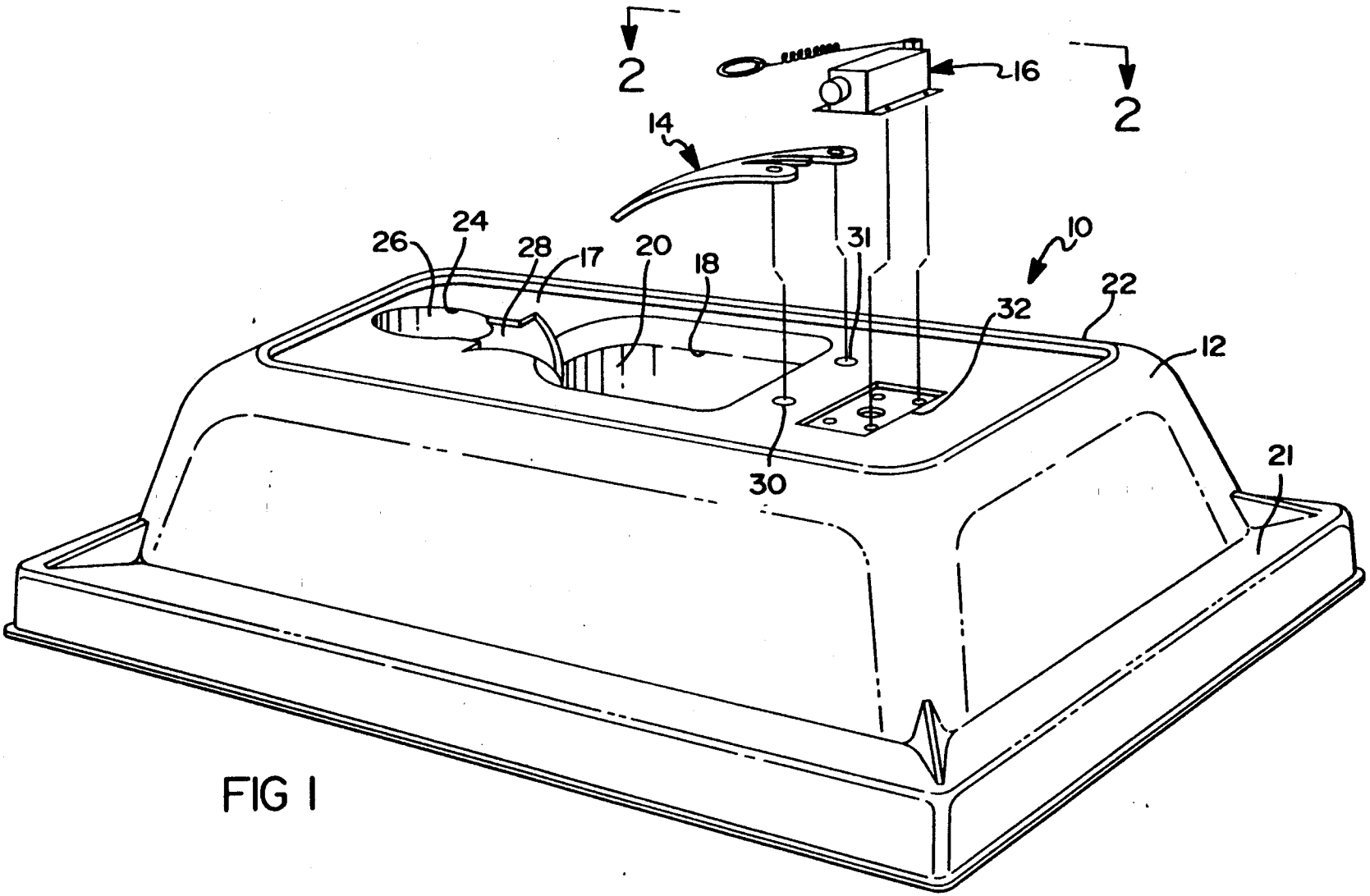
FIG. 1 is a partially exploded perspective view of counting apparatus embodying the principles of the subject invention.

As shown in FIG. 1, counting apparatus 10 is shown in a partially exploded view.

A person versed in the art will appreciate that the subject apparatus can be utilized for counting objects of many different types. The subject apparatus is not limited to counting beverage cans and bottles, but would have particular usage in any environment in which it is desired to count the number of objects which are dropped into a bin, box, bag, or other receptable. For purposes of the subject specification, this apparatus is described as being a bottle counter because counting of returnable beverage bottles is the primary purpose for which this apparatus was devised.

The counting apparatus 10 includes a shroud 12, a paddle assembly 14, and a counter assembly 16.

In the illustrated embodiment, the shroud 12 measures approximately 22.25 inches long, 13.25 inches deep, and 7.5 inches high. The shroud 12 may be of any suitable material, but it has been found satisfactory when manufactured of an injection molded plastic of a suitable size for placement of the shroud over bins of most commonly used sizes for return of beverage bottles, the bins customarily being lined with a plastic bag to be filled with beverage bottles so that each bag is returned while the bins are reused with new bag liners.

The shroud 12 in the illustrated embodiment has a top surface 17 which is essentially a flat horizontal surface. In the preferred embodiment the shroud 12 is provided with a large hole 18 with a downwardly extending side 20 which forms a passage approximately four inches long extending downward from the top surface 17. Shroud 12 includes a concave radially situated extension 21 which permits placing shroud 12 on bins of various sizes which can be spanned by extension 21.

Top surface 17 of shroud 12 in the preferred embodiment also includes a ridge 22 around its perimeter to prevent objects resting on top surface 17 rolling off shroud 12. Shroud 12 also includes a recess 24 which in the preferred embodiment has a downwardly extending wall 26 and a bottom surface, which is not shown, at the bottom of recess 24. One example of each object, such as a particular trademark soft drink bottle, being counted is placed in recess 24 as a reminder of what objects are in the bin below shroud 12.

A recessed drainage channel 28 is provided connecting recess 24 to hole 18 to facilitate tidy drainage of fluids which may become trapped from time to time in recess 24 so that such fluids may be drained through the hole 18.

A pair of holes 30 and 31 are provided in top surface 17 of shroud 12 to secure paddle assembly 14 to shroud 12. A shallow counter recess 32 is provided in top surface 17 of shroud 12 to accommodate receiving the counter assembly 16.

The structural details of paddle assembly 14 are illustrated in FIGS. 2–8.

Figure 2:
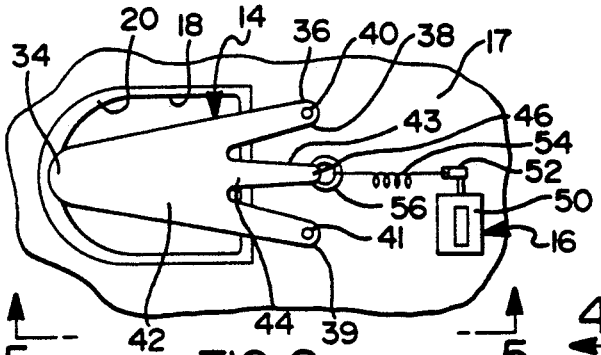
FIG. 2 is a partial plan view of the apparatus in FIG. 1 taken along lines 2—2.

As shown in FIG. 2, paddle assembly 14 includes a free end 34 and a fixed end 36 and in the preferred embodiment is made a single piece of injection molded plastic material.

As shown in FIGS. 2–8, the paddle assembly 14 in the illustrated embodiment at fixed end 36 has two arms 38 and 39 secured to top surface 17 of shroud 12 by a pair of rivets 40 and 41.

Paddle assembly 14 includes a center section 42 between the free end 34 and the fixed end 36. Paddle assembly 14 includes an extension arm 43 which has a first end 44 secured to the center section 42 and a second end 46 attached to the counter assembly 16.

Figure 4:
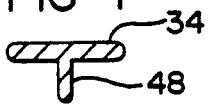
FIG. 4 is a partial cross sectional view of the apparatus in FIG. 3 taken along lines 4—4.

A stiffener ridge 48 shown in cross section in FIG. 4 extends the length of the bottom of paddle assembly 14 from the free end 34 down the entire length of extension arm 43 to second end 46.

The counter assembly 16 includes a conventional mechanical counter 50 which advances the counter display by one unit each time the counter arm 52 is rotated through a predetermined angular movement. The counter assembly 16 includes a tension spring 54 connecting the counter arm 52 through a ring 56 which passes through ridge 48 under second end 46 to connect the extension arm 43 to the counter assembly 16.

Figure 3:
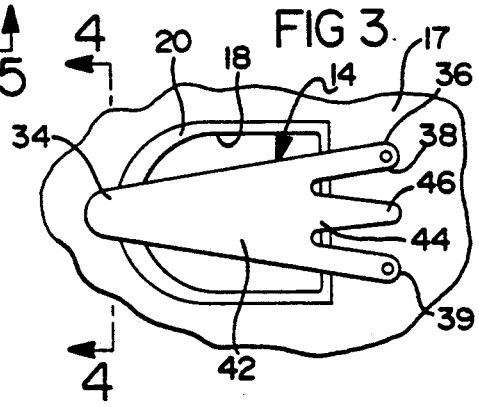
FIG. 3 is a partial plan view of the apparatus in FIG. 2 with the paddle outside the shroud.

As shown in FIG. 3, paddle assembly 14 is manufactured in a length selected so that free end 34 can extend from fixed end 36 completely across hole 18. As shown in FIG. 3, free end 34 is resting on top surface 17 so paddle assembly 14 completely spans hole 18, but free end 34 is normally in hole 18. The long length of paddle assembly 14 assures as each object passes through hole 18 paddle assembly 14 presses against the object without following contours of the object which could trigger false counts.

Figure 5:
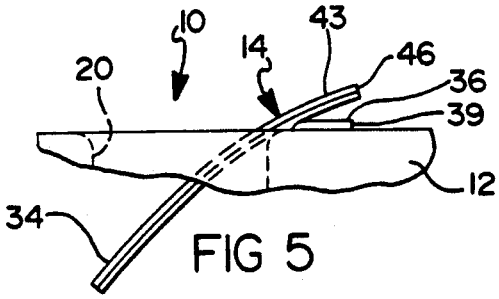
FIG. 5 is a partial side view of the apparatus in FIG. 2 taken along lines 5—5.

As shown in FIG. 5, when counting apparatus 10 is ready to be utilized the free end 34 is tightly held in a predetermined position against side 20 of hole 18 by tensile force within paddle assembly 14. As shown in FIGS. 2 and 5, paddle assembly 14 substantially seals hole 18 so as to prevent passage of bottles through hole 18.

Figure 6:
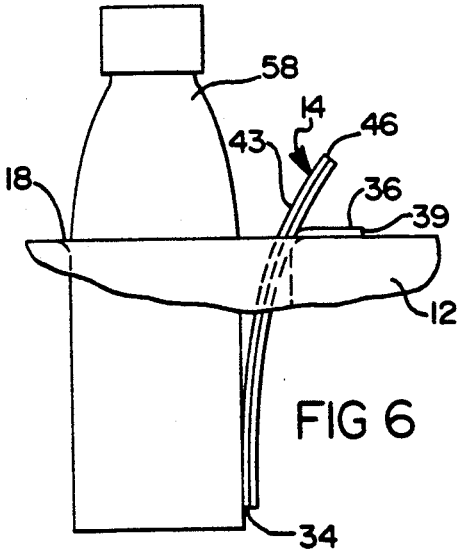
FIG. 6 is a partial side view of the apparatus in FIG. 5 showing a bottle being counted.

As shown in FIG. 6, when a bottle 58 is pushed downward in hole 18 the bottle 58 presses against paddle assembly 14, moving free end 34 of paddle assembly 14 from the first position shown in FIG. 5 where it abuts side 20 of hole 18 to a second position shown in FIG. 6 where free end 34 is permits bottle 58 to pass through hole 18 until bottle 58 clears paddle assembly 14. As shown in FIGS. 5 and 6, when bottle 58 passes through hole 18 the second end 46 of extension arm 43 moves from a first position shown in FIG. 5 to a second position shown in FIG. 6 in which extension arm 46 is elevated and rotated to a predetermined position above top surface 17. As second end 46 is elevated and rotated, it moves to the left relative to the fixed end 36 of paddle assembly 14, applying tension in spring 54. As spring 54 is pulled, counter arm 52 is pulled angularly in a conventional manner, advancing the counter 50 reading by one count.

As bottle 58 passes through hole 18, the free end 34 of paddle assembly 14 is allowed to return to the first position shown in FIG. 5 where it abuts side 20 of hole 18. As it does so, second end 46 of extension arm 43 is lowered and rotated to the right as shown in FIG. 5, resetting the counter 50 for the next count when another bottle is passed through shroud 12.

Figure 7:
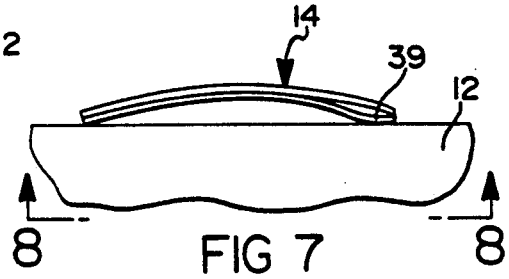
FIG. 7 is a partial side view of the apparatus in FIG. 5 with the counter paddle outside the shroud.

As shown in FIG. 7, paddle assembly 14 is molded to have a natural curvature so it maintains a certain predetermined amount of force against side 20 of hole 18 as shown in FIG. 5 and so it resists passage of bottle 58 with enough force to prevent accidental passage of bottle 58 but with insufficient force to crush bottle 58.

Figure 8:
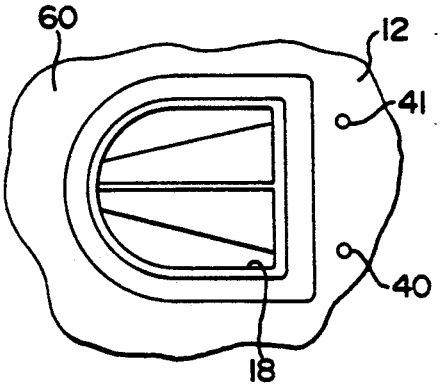
FIG. 8 is a partial plan view of the apparatus in FIG. 7 taken along lines 8—8.

As shown in FIG. 8, when hole 18 is viewed from inside the bin on which shroud 12 is positioned, the bottom surface 60 of shroud 12 is shown to have a continuous curvature at the top of hole 18, as also seen in FIG. 1, to facilitate rapid insertion of bottle 58 into hole 18 and rapid counting.

I claim:

1. Counting apparatus for counting objects comprising, in combination, a shroud for separating object which have been counted from objects which have not been counted, a hole in said shroud through which said objects may be passed, a hingeless, unitary paddle in said hole, said paddle being movable between a first position in which said paddle closes said hole so as to prevent one of said objects passing through said hole and a second position in which said paddle permits passage of one of said objects through said hole, said paddle being movable from said first position to said second position in response to one of said objects being pushed through said hole, and counter means for counting the number of times said paddle is moved from said first position to said second position whereby the number of said objects moved through said shroud is counted by counting movements of said paddle from said first position to said second position.

2. The counting apparatus of claim 1 further comprising display means in said shroud for receiving and displaying one of said objects.

3. The counting apparatus of claim 1 wherein said paddle includes a flexible body defined by fixed and movable ends, said movable end being positioned in said hole so as to close said hole against the passage of said objects when said paddle movable end is in a first position and so as to permit the passage of one of said objects through said hole when said paddle movable end is in a second position, said fixed end being secured to said shroud so as to support said paddle in said hole.

4. The counting apparatus of claim 3 wherein said flexible body biases said paddle to said first position and permits one of said objects to be pushed through said hole against said paddle so as to permit moving said paddle to said second position one time while each one of said objects passes through said hole.

5. The counting apparatus of claim 4 further comprising an extension member secured to said paddle body between said fixed end and movable end, said extension member having a fixed end secured to said paddle between said movable paddle end and fixed paddle end and a free second end proximate said fixed paddle end whereby movement of said paddle causes a corresponding movement of said extension member, said paddle extension being in a certain position when said paddle free end is in said first position and said paddle extension being in another position when said paddle free end is in said second position.

6. The counting apparatus of claim 5 wherein said counter means includes a counter arm, a counter for indicating a number of times said counter arm is moved, and tension means connecting said counter arm to said paddle extension free end whereby movement of one of said objects through said hole moves said paddle from said first position to said second position, causing movement of said paddle extension from said certain to said other position, causing movement of said tension means so as to move said counter arm to cause said counter to indicate the next higher number.

7. The counting apparatus of claim 3 further comprising display means in said shroud for receiving and displaying one of said objects.

8. Counting apparatus for counting objects dropped into a container comprising, in combination, a shroud for covering at least part of said container and separating objects which have been counted from objects which have not been counted, a hole in said shroud through which said objects may be passed, a hingeless, unitary paddle in said hole, said paddle being movable between a first position in which said paddle closes said hole so as to prevent one of said objects passing through said hole and a second position in which said paddle permits passage of one of said objects through said hole, said paddle being movable from said first position to said second position in response to one of said objects being pushed through said hole, and counter means for counting the number of times said paddle is moved from said first position to said second position whereby the number of said objects moved through said shroud is counted by counting movements of said paddle from said first position to said second position so as to count the number of said objects which have been passed through said shroud into said container.

9. The counting apparatus of claim 8 further comprising display means in said shroud for receiving and displaying one of said objects whereby one of said objects may be placed in said display means to show of the objects which are to be passed through said shroud into said container.

10. The counting apparatus of claim 8 wherein said paddle includes a flexible body defined by fixed and movable ends, said movable end being positioned in said hole so as to close said hole against the passage of said objects when said paddle movable end is in a first position and so as to permit the passage of said objects through said hole when said paddle movable end is in a second position, said fixed end being secured to said shroud so as to support said paddle in said hole, said flexible body biasing said paddle to said first position and permitting one of said objects to be pushed through said hole against said paddle so as to permit moving said paddle to said second position one time while each of said objects passes through said hole.

* * * * *